United States Patent [19]

Wright et al.

[11] Patent Number: 4,580,867

[45] Date of Patent: Apr. 8, 1986

[54] METHOD AND APPARATUS FOR TERMINATING A RECIPROCABLE CONNECTOR

[75] Inventors: Steve Wright; Michael J. Gardner, both of Glen Ellyn, Ill.

[73] Assignee: Molex Incorporated, Lisle, Ill.

[21] Appl. No.: 701,044

[22] Filed: Feb. 12, 1985

[51] Int. Cl.[4] ..... H01R 13/50

[52] U.S. Cl. ..... 339/176 MF; 339/75 MP; 29/749; 29/754

[58] Field of Search ..... 339/17 C, 17 F, 176 MF, 339/176 MP, 91 R, 75 MP; 29/749, 753, 754

[56] References Cited

U.S. PATENT DOCUMENTS

| | | | |
|---|---|---|---|
| 3,803,695 | 4/1974 | Tucci | 29/749 |
| 4,480,886 | 11/1984 | Bergmanin | 339/75 MP |
| 4,519,133 | 5/1985 | Pansanel | 339/75 MP |
| 4,525,927 | 7/1985 | Guerout et al. | 29/753 |

FOREIGN PATENT DOCUMENTS

| | | | |
|---|---|---|---|
| 21237 | 1/1981 | European Pat. Off. | 29/749 |
| 40490 | 11/1981 | European Pat. Off. | 29/749 |

*Primary Examiner*—Gil Weidenfeld
*Assistant Examiner*—David L. Pirlot
*Attorney, Agent, or Firm*—Louis A. Hecht; Bruce R. Mansfield

[57] ABSTRACT

Disclosed is a method and apparatus for automatically terminating the end of a flat flexible cable in a reciprocably actuable low insertion force connector having a dielectric housing with a cable receiving cavity and a terminal member disposed in the cavity. The connector also includes a reciprocating cover having a cable receiving aperture and mounting for reciprocable movement between an open position for receiving the cable, and a closed position for terminating the cable within the connector. The apparatus includes an insertion head and an arrangement for automatically positioning the insertion head with respect to the cable receiving aperture of the connector cover. The insertion head further includes a reciprocable cable feeder which inserts the cable end through the cover aperture, and a reciprocable actuator which moves the cover upon insertion of the cable and the connector.

8 Claims, 7 Drawing Figures

METHOD AND APPARATUS FOR TERMINATING A RECIPROCABLE CONNECTOR

BACKGROUND OF THE INVENTION

1. Field of the Invention

The present invention pertains to low insertion force electrical connectors for flat-type cable assemblies, and in particular to such assemblies having components which are reciprocably actuable to terminate a conductor therein.

2. Discussion of the Prior Art

European Patent application No. 0,111,144 filed Dec. 12, 1983 and assigned to the assignee of the present invention discloses a low insertion force connector for terminating a flat flexible cable inserted therein. The connector includes a terminal having an upstanding resilient arm member with a contact portion adjacent its free end. A dielectric support wall extending generally parallel to the terminal arm provides a support surface immediately opposite the terminal contact surface. A flat flexible cable inserted between the support and contact surfaces causes deflection of the resilient arm, thereby generating a bias force maintaining a contact pressure between the terminal contact surface and the flat flexible cable conductor.

European Patent Application No. 0,099,680 filed Jan. 7, 1983 describes a similar low insertion force connector having an improved reciprocable terminating arrangement. The connector includes an upstanding resilient terminal arm having a contact surface. A reciprocal cover with a downwardly depending tongue-like actuator member is mounted to the connector so as to be movable between an upper open position and a lower terminated position. While the cover is in its upper open position, a flat flexible cable is inserted in the connector arrangement so as to overly the terminal arm contact surface. At this time, there is no bias force imparted to the contact surface, and the cable is inserted freely into the connector arrangement. After the cable is inserted in the connector, the cover is depressed, bringing the actuator member in contact with that portion of the cable located immediately adjacent the terminal contact surface. The terminal arm is thereby deflected, imparting a contact pressure bias force to the terminal contact surface. Any frictional forces generated by the connector actuation are located between the reverse, noncontacting, side of the flat flexible cable and the actuator member.

Connector part numbers 5597 and 5598 offered for sale by the assignee of the present invention provide a further improvement over the last-mentioned connector. These connector parts include a reciprocable actuator cover having a rectangular-shaped slot through which the flat flexible cable is inserted while the cover is in its upper open position. Insertion forces and bending of the flat flexible cable are reduced, due to improved alignment between the cover aperture and the terminal. The terminal configuration includes coplanar spaced-apart arm portions, one of which carries the contact surface, and the other of which is supported against the housing wall. This terminal arrangement affords improved control over contact pressures, and provides higher contact pressures while eliminating bending stress in the outer housing wall.

Heretofore, termination of a flat flexible cable in the above-described connector arrangements requires manual insertion of a free cable end in the connector, followed by depression of the connector cover so as to actuate the cable termination. Such techniques are labor intensive, resulting in a reduced volume output.

SUMMARY OF THE INVENTION

It is therefore and object of the present invention to provide a fully automated method for terminating a flat flexible cable in a reciprocating actuable, low insertion force connector.

A related object of the present invention is to provide an automated apparatus for loading and actuating a low insertion force connector so as to terminate a flat flexible cable therein.

Another object of the present invention is to provide a method and apparatus for automatically terminating a flat flexible cable at predetermined locations about a printed circuit board.

These and other objects of the present invention are provided in apparatus for automatically terminating the end of a flat flexible cable in a reciprocably actuable low insertion force connector. The connector includes a dielectric housing having a cable receiving cavity, a terminal member disposed in said cavity adapted to mate with said cable end, and a reciprocating cover having a cable receiving aperture communicating with said cavity and mounted on said housing for sliding movement between an open position where the cable end is freely insertable through said aperture and a closed position where said cable end is electrically terminated and held in said cavity. The apparatus comprises an insertion head, and means for automatically positioning said insertion head adjacent said cable receiving aperture of said connector cover when said connector cover is in said open position. The insertion head includes a reciprocable cable feeder moveable between an initial position where said cable end is spaced from said cover and an extended, loaded position where said cable end is inserted through said aperture; gripping means for selectively engaging said cable when said cable feeder is moved to said loaded position and for selectively releasing said cable when said cable feeder attains said loaded position; and a reciprocable actuator moveable in response to said cable feeder arriving at to its loaded position between an unterminated cover engaging position when said cover is in its open position and an extended, terminated position for moving said cover to its closed position.

Also in accordance with the present invention is a method of automatically terminating the end of a flat flexible cable in a reciprocably actuable low insertion force connector with a terminating apparatus. The said connector includes a dielectric housing having a cable receiving cavity;

a terminal member disposed in said cavity adapted to mate with said cable end, and a reciprocating cover having a cable receiving aperture communicating with said cavity and mounted on said housing for sliding movement between an open position where the cable end is freely insertable through said aperture and a closed position where said cable end is electrically terminated and held in said cavity. The terminating apparatus comprises an insertion head, and means for automatically positioning the insertion head. The insertion head includes a reciprocable cable feeder moveable between an initial position and an extended loaded position, gripping means for selectively engaging and releasing said cable, and a reciprocable actuator moveable between an unterminated cover engaging position and an extended, terminated position. The method comprising the steps of:

positioning the insertion head adjacent the cable receiving aperture of the connector when the connector is in said open position;

engaging the cable when the cable feeder is located at said initial position;

moving the cable feeder from said initial position to said extended loaded position, such that the cable is inserted through said aperture; and moving the actuator, in response to the cable feeder arriving at said loaded position, between said unterminated cover engaging position and said extended, terminated position whereupon the cover is moved to said closed position so as to terminate the end of the flat flexible cable in the connector.

BRIEF DESCRIPTION OF THE DRAWINGS

In the drawings, wherein like elements are referenced alike.

DETAILED DESCRIPTION OF THE PREFERRED EMBODIMENT

Figure 1:
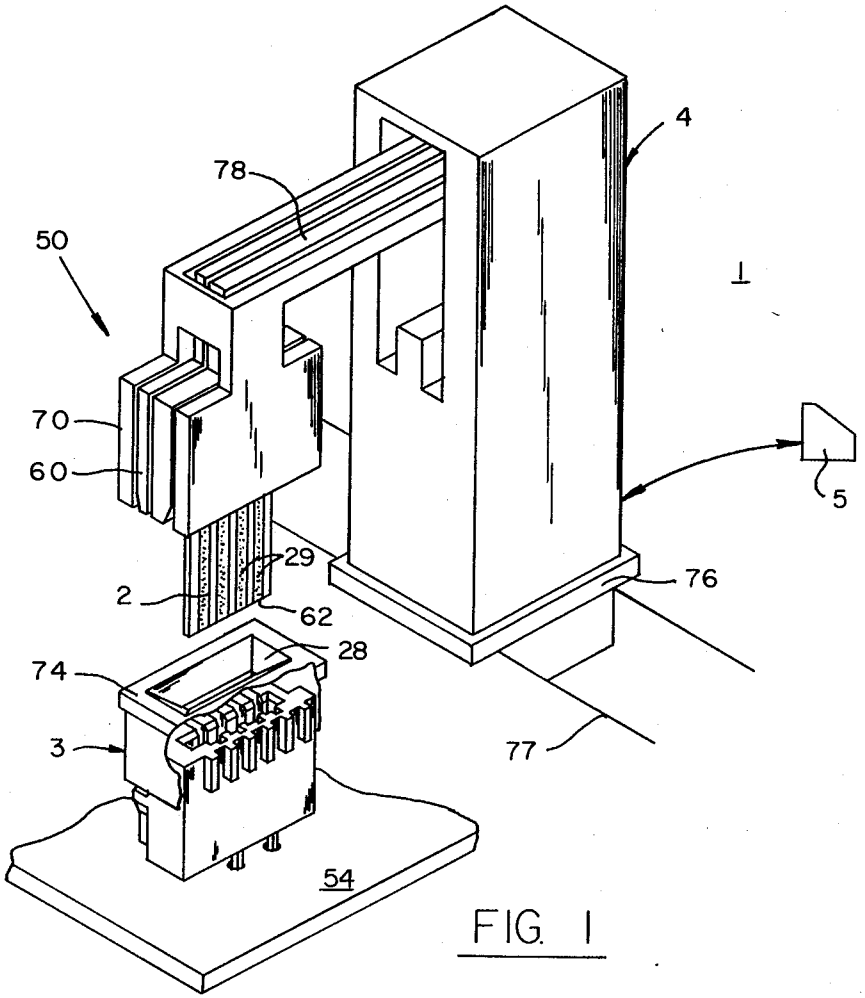
FIG. 1 is a perspective view of an automated termination apparatus according to the present invention.

FIG. 1 shows an automated cable insertion and termination apparatus generally indicated at 1, for terminating a flat flexible cable 2 in a reciprocably actuable low insertion force connector 3. Apparatus 1 includes a programmable manipulator 4 which, for example, comprises a commercially available robotic arm operating under the control of a computer terminal 5. The programmable manipulator 4 is of a type capable of inserting cable 2 in connector 3, and thereafter depressing the connector cover to effect termination of cable within the connector.

Figure 6:
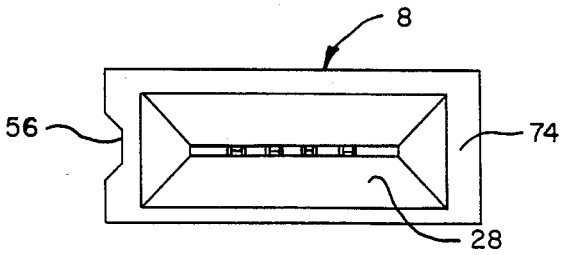
FIGS. 6 and 7 show the connector of FIGS. 1–5 prior to termination.
Figure 3:
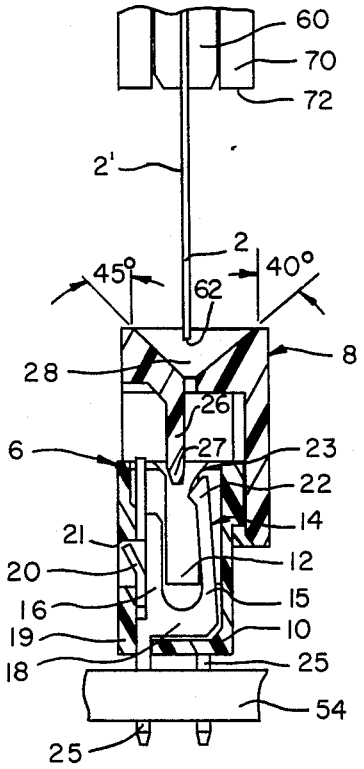
FIGS. 3–5 show the automated termination technique of the present invention in three progressive steps.
Figure 4:
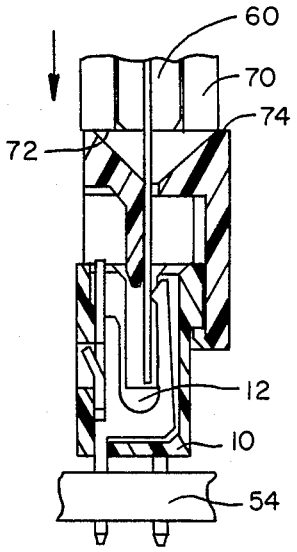
Figure 7:
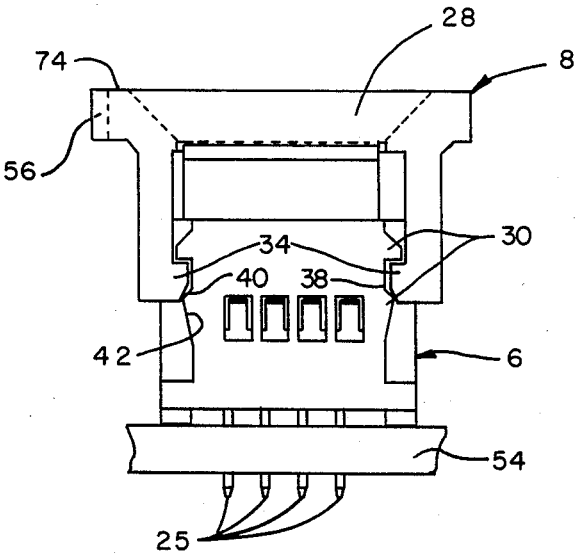
Figure 5:
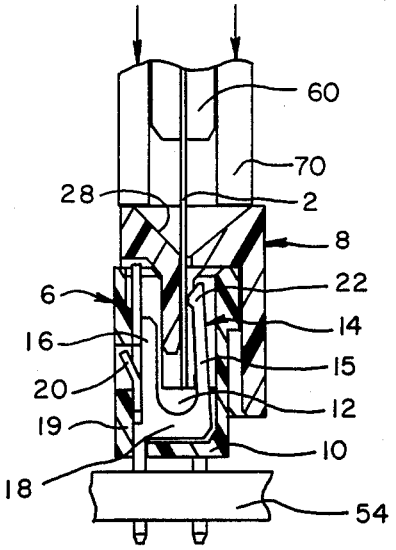

Operation of connector 3 will now be described with reference to FIGS. 2–7. As is shown most clearly in FIGS. 2 and 3, connector 3 comprises a housing 6 and a cover 8, which are made of an insulative resin or other dielectric material. Cover 8 is mounted for sliding movement between a first open position, (as shown in FIGS. 3, 4 and 7), and a second closed position (as shown in FIG. 5). Housing 6 includes an upper open end a bottom wall 10, and defines an inner cavity 12 for receiving a plurality of terminals 14.

Terminals 14 are conveniently formed from an integral stamped member, having a pair of generally elongate, coplanar, spaced-apart arms 15,16 which are joined at their lower end to a common base member, 18. In their undeflected condition as shown in FIG. 3, the upper free ends of arms 15,16 converge, but are spaced apart from each other a predetermined distance. Terminal 14 further includes an outwardly struck tang 20, which engages a ledge 21 formed in housing 6 to retain terminal 14 therein. The arm 15 of terminal 14 is generally elongated in the direction of movement of cover 8, and is laterally resilient, setting up a bias force when deflected in transverse directions (see FIG. 5). The free end of resilient arm 15 includes a hook-shaped outwardly protruding contact portion 22 having a contact surface 23. Solder tails 25 are conveniently formed in the integral stamping of terminal 14, to extend downwardly from base member 18, projecting through convenient openings formed in the bottom wall 10 of housing 6.

Cover 8 is provided with a downwardly extending actuator member or tongue 26 having a lower free end 27 which is inserted between arms 15,16 as actuator cover 8 is moved from its open position (FIGS. 3,4) to its closed position (FIG. 5). Tongue member 26 has a thickness substantially greater than the predetermined distance between the free ends of arms 15, 16 when terminal 14 is in a released configuration. With the insertion of tongue member 26 between the free ends of arms 15,16, arm 15 is deflected in a transverse direction while arm 16 remains stationary. Transverse deflection of arm 15 creates a bias force which acts upon the hook-shaped contact portion 22, being supported by the base portion 18 of terminal 14, which abuts the housing sidewall at location 19.

Cover 8 includes a funnel-shaped slot 28 through which cable 2 is freely inserted while cover 8 is in its first open position. The free end of cable 2 is inserted between arms 15,16, and at least adjacent the contact portion 22. Slot 28 is located immediately above terminal contact surface 23, facilitating ready insertion of cable 2 without binding either in cover 8 or housing cavity 12. Cover 8 is maintained in its upper open position during cable insertion by a detent arrangement on the housing endwalls, as will be explained herein.

With reference to FIG. 3, the lefthand tapered wall of slot 28 is formed at an angle of 45 degrees with respect to the vertical, and the righthand wall is formed at an angle of 40 degrees. After cable 2 is fully inserted, actuator cover 8 is moved to its second closed position, with support member 26 being inserted between arms 15,16 to create a pressure force between contact portion 22 and tongue-like support member 26. Cable 2 remains stationary during the lowering of actuator cover 8, and any friction forces resulting are localized between tongue 26 of actuator cover 8 and the reverse side 2' of cable 2 (that side not carrying the conductor traces 29). Likewise, cable 2 remains stationary during upward movement of actuator cover 8 to its first open position. Actuator cover 8 is movably mounted on housing 6 so as to be reciprocated from the first open position of FIGS. 3,4 to the closed or terminated position of FIG. 5, whereupon electrical connection between the circuit conductors 29 of cable 2 and the terminal contact projections is established.

Figure 2:
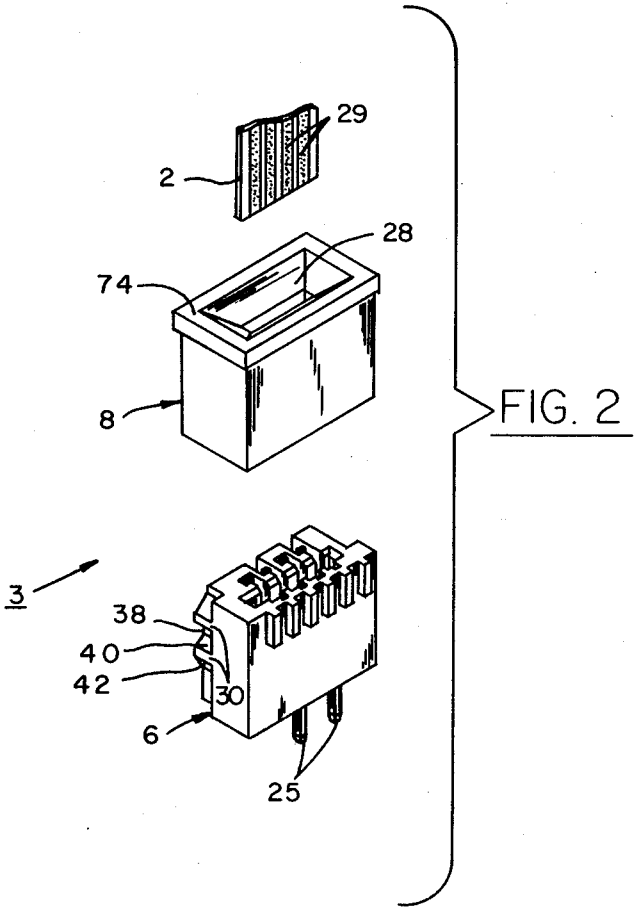
FIG. 2 is an exploded view of the connector of FIG. 1.

FIG. 2 is an exploded view of connector 3 showing the latching detents 30 integrally formed on the housing end walls. Detents 30 cooperate with the inwardly projecting resilient latches 34 formed at the lower free end 36 of cover 8. Cover 8 is shown in phantom in FIG. 7 in its open or predetermined position, with latches 34 engaging a first pocket 38 which fixes cover 8 in position during downward insertion of cable 2. After cable 2 is fully inserted, cover 8 is depressed such that latches 34 cam against the ramp surfaces 40,42 of detents 30 to assume a closed or terminated position. During this depression of cover 8, tongue-like actuator member 26 is wedged between terminal arms 15,16 to terminate cable 2.

Referring now to FIGS. 1 and 3–5, automated termination of connector 3 using the method and apparatus for the present invention will be described. Programmable manipulator 4 includes an insertion head 50 as shown in greater detail in the upper portion of FIGS. 3–5. Programmable manipulator 4, having a movable base 76 mounted on a track 77 and an extensible arm 78 is of a type capable of grasping and thereafter moving cable 2 to any prescribed portion of a printed circuit board 54 to which connectors 3 have previously been mounted, preferably by other programmable munipulator apparatus. Programmable manipulator 4 is capable of locating cable 2 with sufficient accuracy proximate to each funnel shaped opening 28 such that the cable 2 will be guided by funnel 28 to the interior cavity 12 of connector 3. An example of a commercially available programmable manipulator is the Puma model 560 robotic arm manufactured by Unimation Inc. of Danbury, Conn. As shown in FIGS. 6 and 7, cover 8 has a locating notch 56, formed in one end for engagement with a sensor switch, pressure roller, or the like sensing means mounted on programmable manipulator 4 to help align insertion head 50.

Insertion head 50 has a first reciprocable cable feeding portion 60 which is movable between an initial position (as indicated in FIG. 3) and an extended loaded position (as shown in FIGS. 4 and 5). Cable feeder 60 is located at the lower end of insertion head 50, and includes grippers for engaging cable 2 at a predetermined distance from its free end 62. The predetermined distance is chosen to correspond to the depth of the cable receiving passageway formed by cover 8 and the lower portion of connector 3, in the connector's open, unloaded position. Insertion head 50 further includes an extensible connector actuator 70 having a lower free end 72 for engaging the outer periphery 74 of the upper surface of cover 8. In the preferred embodiment of the cable insertion and terminating apparatus of the present invention, cable feeder 60 is received within actuator 70, although other arrangements will be apparent to those skilled in the art.

As can be seen in FIGS. 3 and 4, cable feeder 60 and cover actuator 70 of insertion head 50 are maintained in a fixed position with respect to each other, and are moved as a unit from an upper initial "cable locating" position of FIG. 3 to the lower "cable inserted" position of FIG. 4. Upon advancement of insertion head 50 to the position shown in FIG. 4, cable 2 is fully inserted in connector 3, being positioned adjacent the terminal contact surface 23. As shown in FIG. 4, a lower surface 72 of cover actuator 70 is positioned immediately adjacent the upper surface 74 of cover 3, but has not yet advanced cover 8 in a downward direction.

Thereafter, as indicated in FIG. 5, cable feeder 60 is preferably maintained in a fixed position, while cover actuator 70 is extended to thereby depress cover 8 toward its fully terminated position, with the tongue-like support member 26 being positioned adjacent terminal contact 22 to thereby urge cable 2 against the terminal contact.

After depressing cover 8, actuator 70 is retracted to a position adjacent the free end of cable feeder 60, and insertion head 50 is removed from the vicinity of connector 3, ready for another cable insertion operation.

The following operational steps will become apparent with reference the foregoing description. First, cable feeder 60 of insertion head 50 engages cable 2 at a predetermined position from the cable free end. Thereafter, the insertion head 50 is lowered until its bottom free end 72 is positioned adjacent the upper surface 74 of actuator cover 8, such that a predetermined distance of cable 2 is received within connctor 3 to accomplish a complete insertion, with the conductor traces 29 of cable 2 being positioned adjacent the contact surfaces 23 of the terminals 14. Therafter, in response to feeder 60 attaining a loaded position, actuator 70 is extended to engage and depress cover 8 from an unloaded open position to a lowered terminated position, whereby the tongue-like support imparts a contact force between the circuit conductors 29 and the terminal contact surfaces 23. During this termination step, cable feeder 60 and cable 2 are maintained in a stationary position to eliminate relative movement between connector 2 and contact surface 23. After tongue-like support member 26 has been wedged between the arms 15,16 of terminal 14 so as to set up the contact pressure force, actuator 70 is withdrawn from the upper surface of cover 8 and insertion head 50 is removed, being made ready for a subsequent cable insertion operation.

We claim:

1. Apparatus for automatically terminating the end of a flat flexible cable in a reciprocably actuable low insertion force connector, said connector including a dielectric housing having a cable receiving cavity;

a terminal member disposed in said cavity adapted to mate with said cable end;

a reciprocating cover having a cable receiving aperture communicating with said cavity and mounted on said housing for sliding movement between and open position where the cable end is freely insertable through said aperture and a closed position where said cable end is electrically terminated and held in said cavity; said apparatus comprising:

an insertion head; and means for automatically positioning said insertion head adjacent said cable receiving aperture of said connector cover when said connector cover is in said open position;

said insertion head including a reciprocable cable feeder moveable between an initial position where said cable end is spaced from said cover and an extended, loaded position where said cable end is inserted through said aperture, gripping means for selectively engaging said cable when said cable feeder is moved to said loaded position and for selectively releasing said cable when said cable feeder attains said loaded position, and a reciprocable actuator moveable in response to said cable feeder arriving at its loaded position between an unterminated cover engaging position when said cover is in its open position and an extended, terminated position for moving said cover to its closed position.

2. The apparatus of claim 1 wherein said cable feeder is disposed within said actuator portion, and is mounted for reciprocable sliding movement relative thereto.

3. The apparatus of claim 1 including means for advancing said cable feeder and said actuator together from said initial position to said loaded position, and for thereafter further advancing said actuator portion to said terminated position.

4. The apparatus of claim 1 wherein said cover includes an engaging surface at its outer periphery, and said actuator includes a free end for engaging the outer periphery of said connector cover.

5. The apparatus of claim 1 further including locating means for sensing an index notch formed in said connector cover adjacent said outer periphery thereof, said automatic positioning means responsive to said locating means to position said insertion head adjacent said cover cable receiving aperture.

6. A method of automatically terminating the end of a flat flexible cable in a reciprocably actuable low insertion force connector with a terminating apparatus, said connector including a dielectric housing having a cable receiving cavity;

a terminal member disposed in said cavity adapted to mate with said cable end;

a reciprocating cover having a cable receiving aperture communicating with said cavity and mounted on said housing for sliding movement between an open position where the cable end is freely insertable through said aperture and a closed position where said cable end is electrically terminated and held in said cavity, said terminating apparatus comprising an insertion head, and means for automatically positioning said insertion head, said insertion head including a reciprocable cable feeder moveable between an initial position and an extended loaded position, gripping means for selectively engaging and releasing said cable, and a reciprocable actuator moveable between an unterminated cover engaging position and an extended, terminated position, said method comprising the steps of:

positioning said insertion head adjacent said cable receiving aperture of said connector when said connector is in said open position;

engaging said cable when said cable feeder is located at said initial poistion;

moving said cable feeder from said initial position to said extended loaded position, such that said cable is inserted through said aperture;

moving said actuator, in response to said cable feeder arriving at said loaded position, between said unterminated cover engaging position and said extended, terminated position whereupon said cover is moved to said closed position so as to terminate the end of said flat flexible cable in said connector.

7. The method of claim 6 further comprising the steps of retracting said actuator to said terminated cover engaging position upon termination of said cable in said connector.

8. The method of claim 7 further including the steps of releasing said cable and retracting said cable feeder to said initial position while further retracting said actuator to an initial position located adjacent said initial cable feeder position.

* * * * *